United States Patent [19]

Weese

[11] 4,275,851

[45] Jun. 30, 1981

[54] ORE SAMPLE CRUSHER

[76] Inventor: Charles W. Weese, 1150 N. 200 West #32, Lehi, Utah

[21] Appl. No.: 72,516

[22] Filed: Sep. 4, 1979

[51] Int. Cl.[3] ..... B02C 1/04

[52] U.S. Cl. ..... 241/169; 241/99; 241/264

[58] Field of Search ..... 100/233; 241/99, 168, 241/169, 169.1, 169.2, 262–269

[56] References Cited

U.S. PATENT DOCUMENTS

| | | | |
|---|---|---|---|
| 386,165 | 7/1888 | Sanford | 241/264 |
| 942,135 | 12/1909 | Davis | 100/233 UX |
| 2,264,915 | 12/1941 | Meister | 241/267 |

*Primary Examiner*—Howard N. Goldberg
*Attorney, Agent, or Firm*—Robert K. Rhea

[57] ABSTRACT

An upright inclined leg supported frame includes a jaw movable toward and away from an anvil by a manually reciprocated handle for crushing ore samples entering the spacing between the movable jaw and anvil from a hopper.

2 Claims, 2 Drawing Figures

ORE SAMPLE CRUSHER

BACKGROUND OF THE INVENTION

1. Field of the Invention.

The present invention relates to mineral prospecting and more particularly to an ore sample crusher for pulverizing ore samples to be tested for mineral content.

Natural deposits of minerals are usually combined with earth formations and in prospecting for minerals it is necessary to obtain samples of the mineral containing earth which, because of its compactness, usually results in small rock-like lumps or particles of the ore and earth. These rock-like lumps must be pulverized or reduced to a comminuted state in order to separate the ore from the earth and determine whether or not the ratio of mineral to earth is sufficient to economically justify a mining operation. It is, therefore, desirable to provide a portable apparatus for easily crushing samples of ore adjacent the location in which the ore is found.

2. Description of the Prior Art.

Prior patents for crushing small articles have generally related to ice crushers, such as for crushing ice cubes, or the like. U.S. Pat. No. 3,386,669 discloses an ore crushing apparatus for a mining operation in which slurry contained particles of ore too large to pass through a grizzly are crushed by a ram moving one wall of the grizzly against a breaker plate for crushing ore chunks between the grizzly and plate wherein the crushing members comprise interdigitated teeth for reducing the ore lumps to a size capable of passing through the grizzly walls with the slurry.

Another U.S. Pat. No. 3,915,393 discloses a base having an arm pivotally connected with the base for vertical reciprocation toward and away from the base which moves a crushing head into and out of a crushing bowl for pulverizing a medicinal tablet contained by the bowl.

This invention is distinctive over the ore mining U.S. Pat. No. 3,386,669 by providing planar crushing jaws pulverizing selected quantities of ore manually disposed between the crushing jaws wherein the pulverized ore is dispensed from the jaws into a container. This invention is also distinctive over the tablet crushing U.S. Pat. No. 3,915,393 by providing an increased mechanical advantage between the ore crushing surfaces and in which the ore crushing jaws may be continuously moved toward and away from each other while being fed additional ore samples from an attached hopper.

SUMMARY OF THE INVENTION

A generally upright frame, formed in a generally U-shape, having its flat bight portion inclined upwardly and its legs vertically disposed, is supported by a pair of standards. The frame is provided with a flat anvil member connected with the inner surface of the U-shaped bight portion. A plate-like movable jaw, coextensive with the length of the anvil and the spacing between the frame legs, is rigidly connected to a transverse shaft journalled by the frame legs and is manually movable toward and away from the anvil by an elongated handle rigidly connected with the shaft and movable jaw. The depending edge portion of the movable jaw is provided with a cam surface maintained in close spaced relation with respect to the adjacent surface of the anvil during the pivoting movement of the movable jaw. Ore sample particles are fed into spacing between the jaw and anvil by a hopper secured to the upper end of the U-shaped frame. A chute connected with the depending end of the frame directs pulverized ore samples toward a receptacle.

The principal object of this invention is to provide a light-weight yet sturdily constructed ore sample crusher for pulverizing ore samples adjacent the location were the ore is found.

DESCRIPTION OF THE PREFERRED EMBODIMENT

Figure 1:
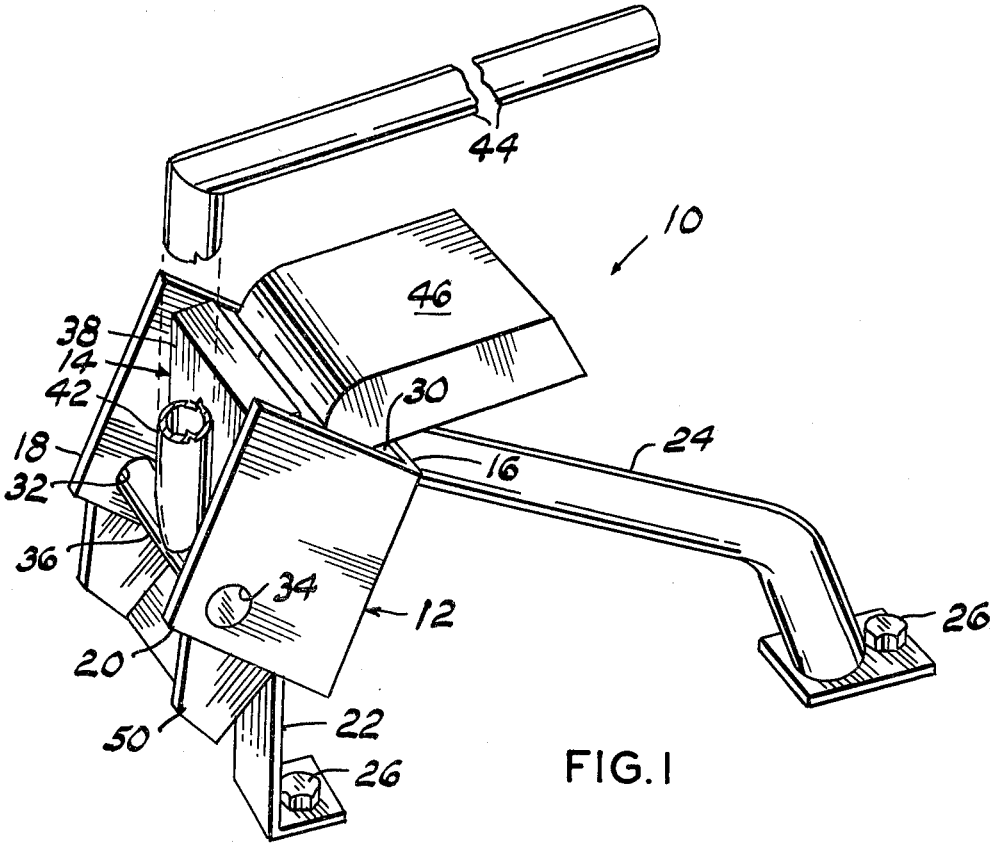
FIG. 1 is a fragmentary perspective view of the ore sample crusher with parts broken away for clarity; and, FIG. 2 is a side elevational view of the crusher, partially in vertical section, and illustrating, by dotted lines, movement of the movable jaw toward and away from the anvil.

Like characters of reference designate like parts in those figures of the drawings in which they occur.

In the drawings:

The reference numeral 10 indicates the device, as a whole, comprising a frame 12 and a movable jaw means 14. The frame 12 is U-shaped in general configuration having a flat bight portion 16 and vertically disposed parallel legs 18 and 20 normal to the plane of the bight portion 16. The bight portion 16 is preferably inclined upwardly and supported at its depending edge by an upright strap-like standard 22. The upper end portion of the bight portion 16, opposite the legs 18 and 20, is rigidly connected with a rearward and downwardly projecting standard, such as a length of pipe 24, or the like. The depending ends of the standards 22 and 24 are secured by screws or bolts 26 to a platform or suitable horizontal surface, such as indicated by the line 28, to rigidly support the frame 12 against movement in any direction. A planar anvil member 30 of a selected thickness, preferably formed from a spring steel material, is coextensive with the inner surface of the bight portion 16, and secured thereto in overlying relation.

Adjacent their forward edge and depending ends, the frame legs 18 and 20 are transversely apertured, as at 32 and 34, in spaced relation with respect to the adjacent plane of the anvil for receiving and journalling the respective end portions of a shaft 36. A movable jaw 38, of substantially equal thickness and length with respect to the anvil 20, is interposed at one end portion between the shaft 36 and adjacent surface of the anvil 30 and rigidly secured to the shaft for pivoting movement between the frame legs toward and away from the anvil. The depending end portion of the movable jaw facing the anvil 30 is arcuately curved coextensive with its width to form a cam surface 40 facing and in close spaced relation with respect to the adjacent surface of the anvil 30 for the purposes presently explained.

An elongated substantially L-shaped handle has its foot portion 42 rigidly connected with the shaft 36 and movable jaw 38 for moving the jaw 38 toward and away from the anvil in a vertical pivoting action about the horizontal axis of the shaft 36 by manual vertical movement of the elongated handle leg portion 44.

Figure 2:
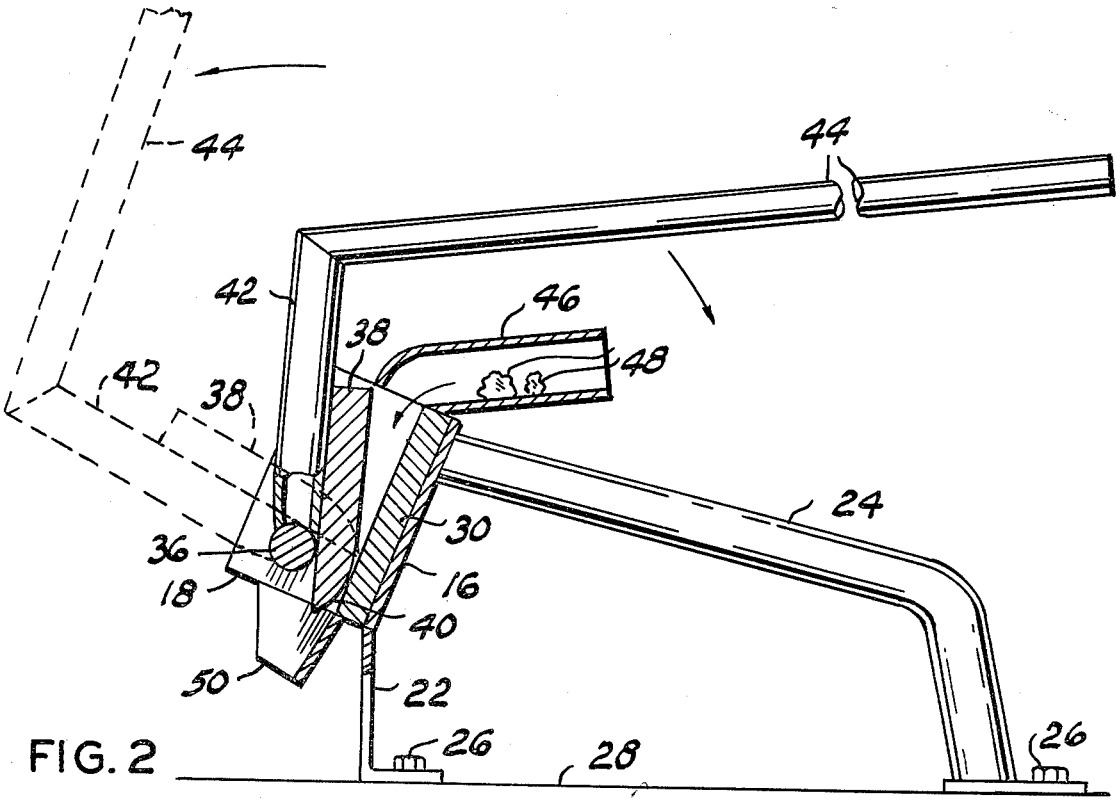

Hopper means, comprising an open ended box or tube member 46, is connected at one end with the upper limit of the base 12 in communication with the spacing between the movable jaw and anvil when the jaw is in the solid position of FIG. 2. The hopper 46 is inclined rearwardly and upwardly for receiving and containing ore samples, as indicated at 48.

A channel-like chute forming member 50 is secured to the depending end of the frame 12 in downwardly and forwardly inclined relation for receiving crushed ore falling by gravity from the anvil 30. Obviously the walls forming the chute 50 may converge downwardly for confining the crushed ore and a receptacle, not shown, may be placed below the chute, if desired.

OPERATION

In operation, the movable jaw means 14 is manually supported in jaw open position, such as is shown by solid lines (FIG. 2). Selected quantities of ore samples 48 are inserted into the hopper 46 and manually moved toward the movable jaw to fall by gravity into the spacing between the jaw and anvil. Manual downward pressure on the handle 44 crushes the ore samples between the jaw 38 and anvil 30. Obviously, a fine mesh screen, not shown, may be attached to the handle for overlying the upper end of the frame to act as an ore retaining stop against flying ore particles, thus insuring true weight and measure of the crushed ore samples. Small particles of the ore enter the spacing between the cam surface 40 and anvil when the jaw means is moved toward its dotted line position (FIG. 2) so that the camming surface 40, fulcrumed about the axis of the shaft 36, by the handle leg 44, provides sufficient leverage to pulverize the ore particles which then fall by gravity through the chute 50.

Obviously the invention is susceptible to changes or alterations without defeating its practicability. Therefore, I do not wish to be confined to the preferred embodiment shown in the drawings and described herein.

I claim:

1. An ore sample crusher, comprising:

a generally U-shaped upright frame characterized by a flat bight portion having parallel legs vertically disposed edgewise;

a pair of standards secured to and supporting the bight portion of said frame on an incline;

a planar anvil overlying and secured to said frame bight portion;

jaw means supported by said frame for movement toward and away from said anvil, said jaw means comprising, a shaft extending between and journaled by said frame legs, a jaw extending transversely between said frame legs and secured at one end portion to said shaft in spaced relation with respect to said anvil, and, handle means secured to said shaft and said movable jaw opposite the anvil;

an ore sample receiving hopper secured to the upper limit of said frame for communication with the spacing between said anvil and said jaw; and, a crushed ore receiving chute connected in depending relation with the lower limit of said frame.

2. The ore sample crusher according to claim 1 in which the transverse depending edge surface of said movable jaw facing said anvil is arcuately curved to form a cam surface disposed in close spaced relation with respect to the adjacent surface of said anvil during vertical pivoting movement of said movable jaw about the horizontal axis of said shaft.

* * * * *